US012753513B2

(12) United States Patent
Pranzetti et al.

(10) Patent No.: US 12,753,513 B2
(45) Date of Patent: Oct. 6, 2026

(54) SYSTEM AND METHOD FOR PERFORMING LOCALIZED ELECTROLESS NICKEL PLATING

(71) Applicant: NUOVO PIGNONE TECNOLOGIE—S.R.L., Florence (IT)

(72) Inventors: Alice Pranzetti, Florence (IT); Michelangelo Bellacci, Florence (IT); Marco Romanelli, Florence (IT); Giovanni Pulci, Rome (IT); Francesco Marra, Rome (IT); Virgilio Genova, Rome (IT); Laura Paglia, Rome (IT)

(73) Assignee: Nuovo Pignone Tecnologie—S.R.L., Florence (IT)

( * ) Notice: Subject to any disclaimer, the term of this patent is extended or adjusted under 35 U.S.C. 154(b) by 0 days.

(21) Appl. No.: 18/723,709

(22) PCT Filed: Dec. 23, 2022

(86) PCT No.: PCT/EP2022/025594
§ 371 (c)(1),
(2) Date: Jun. 24, 2024

(87) PCT Pub. No.: WO2023/126071
PCT Pub. Date: Jul. 6, 2023

(65) Prior Publication Data

US 2025/0051926 A1 Feb. 13, 2025

(30) Foreign Application Priority Data

Dec. 30, 2021 (IT) ..... 102021000033113

(51) Int. Cl.
*C23C 18/16* (2006.01)
*C23C 18/18* (2006.01)
*C23C 18/32* (2006.01)

(52) U.S. Cl.
CPC ..... *C23C 18/1603* (2013.01); *C23C 18/1824* (2013.01); *C23C 18/32* (2013.01)

(58) Field of Classification Search
USPC ..... 118/421, 422, 423, 410, 602–603, 428, 118/429
See application file for complete search history.

(56) References Cited

U.S. PATENT DOCUMENTS 3,934,054 A * 1/1976 Schmeling ..... C23C 18/1669 118/421
5,167,747 A 12/1992 Kadija
(Continued)

FOREIGN PATENT DOCUMENTS

JP S614260 A 1/1986
JP H01139772 A 6/1989
(Continued)

OTHER PUBLICATIONS

English Translation JP-2001073160A (Year: 2001).*
(Continued)

*Primary Examiner* — Yewebdar T Tadesse
(74) *Attorney, Agent, or Firm* — Paul Frank + Collins P.C.

(57) ABSTRACT

A system for performing electroless nickel plating on a portion of a metallic piece comprises a chamber fixedly coupled to the metallic piece during operation of the system so that the portion of the metallic piece and the chamber define a closed volume. The chamber has an inlet to supply at least a plating fluid into the volume and an outlet to discharge the plating fluid from the volume, so that the portion of the metallic piece is exposed to the plating fluid and is plated.

20 Claims, 3 Drawing Sheets

(56) References Cited

U.S. PATENT DOCUMENTS

| | | | | |
|---|---|---|---|---|
| 5,279,725 | A | 1/1994 | Westerman, Jr. | |
| 6,905,588 | B2 | 6/2005 | Uzoh et al. | |
| 2004/0137161 | A1* | 7/2004 | Segawa | H01L 21/76814 118/313 |
| 2007/0104967 | A1* | 5/2007 | Laude | C23C 18/204 428/447 |
| 2014/0262028 | A1 | 9/2014 | Kelekar | |

FOREIGN PATENT DOCUMENTS

| | | | | |
|---|---|---|---|---|
| JP | H02125882 | A | | 5/1990 |
| JP | H1025580 | A | | 1/1998 |
| JP | 2001073160 | A | * | 3/2001 |
| JP | 2004180938 | A | * | 7/2004 |
| JP | 2004250762 | A | | 9/2004 |
| JP | 2006527463 | A | | 11/2006 |
| JP | 2007525595 | A | | 9/2007 |
| JP | 2015038229 | A | * | 2/2015 |
| JP | 2017071659 | A | * | 4/2017 |
| JP | 2019039039 | A | | 3/2019 |
| WO | 2005/076977 | A2 | | 8/2005 |
| WO | 2014/038490 | A1 | | 3/2014 |

OTHER PUBLICATIONS

English Translation JP-2004180938-A (Year: 2004).*
English Translation JP-2015038229-A (Year: 2015).*
English translation JP-2017071659-A (Year: 2017).*

* cited by examiner

SYSTEM AND METHOD FOR PERFORMING LOCALIZED ELECTROLESS NICKEL PLATING

TECHNICAL FIELD

The subject-matter disclosed herein relates to systems and methods for performing localized electroless nickel plating.

BACKGROUND ART

Typically, in order to provide corrosion and/or improve resistance of a metal piece to be used as a mechanical component, the metal piece is subjected to a nickel-plating process. In general, the nickel-plating process is a process of depositing a layer of nickel onto a metal piece.

The process can use the electroplating technique or be electroless. Typically, according to the nickel electroplating, the metal piece is used as the cathode and is immersed into an electrolyte solution wherein the nickel anode is immersed; when electricity flows, the nickel anode forms nickel ions which travel from the anode, through the electrolyte solution and deposit on the cathode, i.e. on the metal piece. On the other hand, electroless nickel plating does not involve the use of electricity: the metal piece is immersed into a plating bath and the deposition of nickel is made by chemical reaction.

However, the repair of the coating of some metal pieces by immersing the piece in a liquid bath is particularly difficult: for example, the portion that has been damaged or worn may be a small portion of the whole piece and therefore it is neither easy nor advantageous to immerse the piece in the liquid bath. Even if, in some cases, it could be impossible to disassemble a damaged portion of the metal piece, for example the blade of an impeller, the whole piece has to be removed from a machine, disassembled and immersed.

SUMMARY

It would be desirable to be able to locally repair the surface coating of a metallic piece, without subjecting the whole metallic piece to a nickel-plating process. In particular, it would be desired to locally repair without removing or disassembling the metallic piece.

According to an aspect, the subject-matter disclosed herein relates to a system for performing electroless nickel plating on a portion of a metallic piece; a chamber is configured to be fixedly coupled to the metallic piece, so that the portion of the metallic piece and the chamber define a closed volume, and to receive, feed and discharge at least a plating fluid so that plating occurs.

According to another aspect, the subject-matter disclosed herein relates to a method for performing localized electroless nickel plating on a portion of a metallic piece, comprising the steps of:

- covering the portion of the metallic piece with a chamber to define a closed volume;
- fixing the chamber to the metallic piece;
- supplying a plating fluid into the volume through an inlet of the chamber;
- discharging the plating fluid from the volume through an outlet of the chamber; and
- removing the chamber from the metallic piece.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
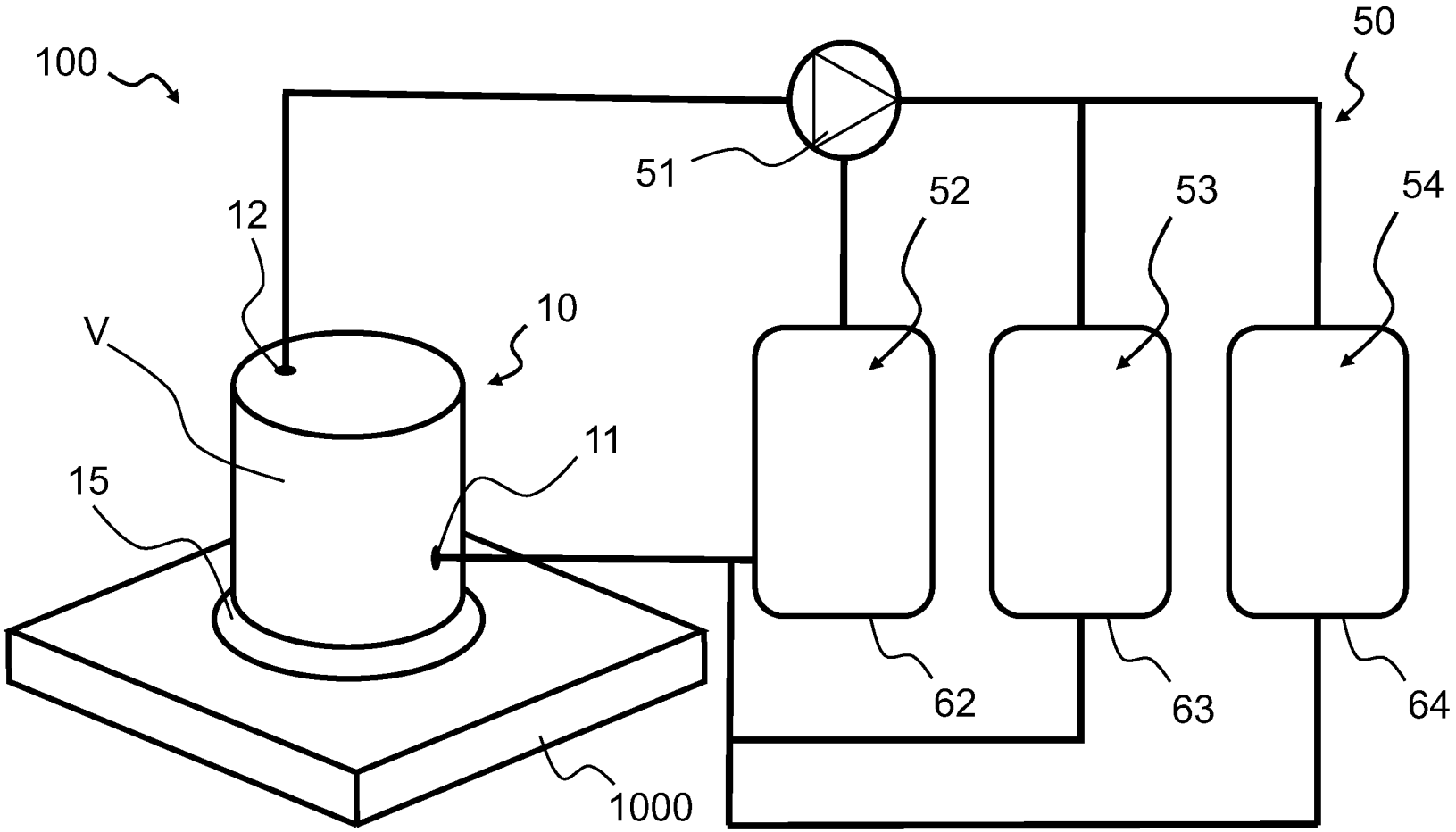
FIG. 1 shows a simplified diagram of an embodiment of a system for performing localized electroless nickel plating.

According to an aspect, the subject-matter disclosed herein relates to a system for locally depositing a layer of nickel plating on a portion of a metallic piece without using electricity. The portion of the metallic piece is to be intended as a surface portion of a whole metallic piece. In fact, the chamber does not surround the whole piece or the whole surface of the piece. The system has a chamber, for example in the form of a jar or a bowl or a shell or a cylindrical can or a sheet, or other form of receptacle, with an inlet and an outlet which can be fixed to the metallic piece, for example with an adhesive or a magnet or a weight. When the chamber is fixed to the metallic piece, it forms a closed volume which can house and feed one or more fluids that are supplied to the volume through the inlet of the chamber and are discharged from the volume through the outlet of the chamber, advantageously in a continuous way. The chamber walls can have a consistent thickness or a variable thickness, and the height of the chamber can vary from different points or segments relative to the metallic piece. At least a first fluid is supplied to the volume is a plating fluid which reacts with a portion (or surface portion) of the metallic piece under the chamber and which forms locally a deposited layer of nickel, i.e. nickel plating. In at least one embodiment, the metallic piece and/or the chamber and/or the plating fluid is heated up to at least 80° C., preferably up to 85° C.-95° C., more preferably up to 88° C.-92° C.

According to another aspect, the subject-matter disclosed herein relates to a method for locally depositing a layer of nickel, i.e. locally forming nickel plating, on a portion of a metallic piece (without using electricity) by flowing a plating fluid on this portion. Preferably, the above-mentioned system may be used for this operation. Advantageously, during the operation, the metallic piece and/or the chamber of the system and/or the plating fluid is heated up to at least 80° C., preferably up to 85° C.-95° C., more preferably up to 88° C.-92° C.

Reference now will be made in detail to embodiments of the disclosure, examples of which are illustrated in the drawings. The examples and drawing figures are provided by way of explanation of the disclosure, and should not be construed as a limitation of the disclosure. In fact, it will be apparent to those skilled in the art that various modifications and variations can be made in the present disclosure without departing from the scope or spirit of the disclosure. In the following description, similar reference numerals are used for the illustration of figures of the embodiments to indicate elements performing the same or similar functions. Moreover, for clarity of illustration, some references may be not repeated in all the figures.

In FIG. 1 there is shown a diagram of an embodiment of a system for performing localized electroless nickel plating generally indicated with reference numeral 100 which comprises a chamber 10, for example a rigid chamber 10.

Figure 2:
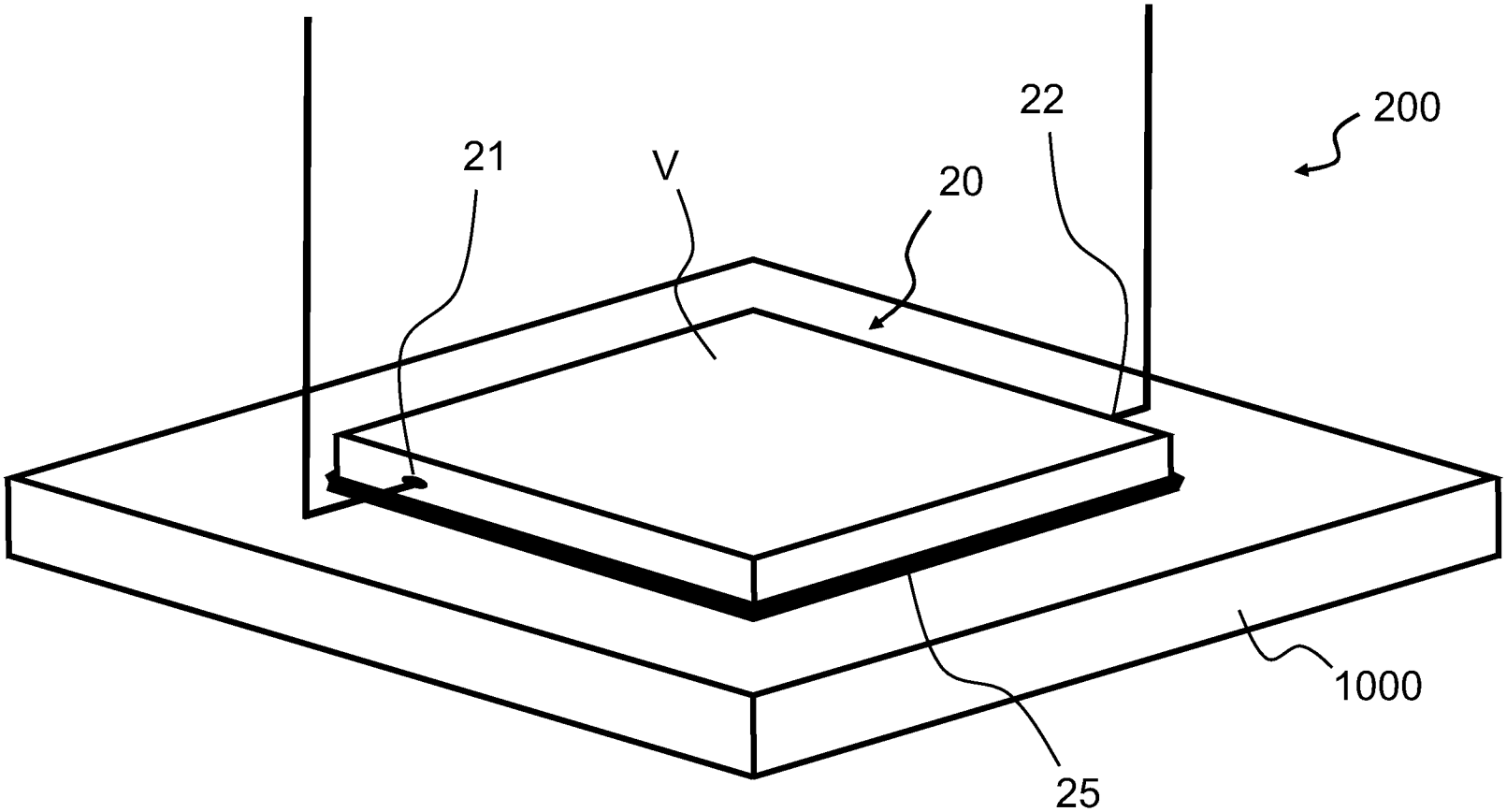
FIG. 2 shows a partial simplified diagram of an embodiment of the system for performing localized electroless nickel plating.

However, it should be noted that the chamber can be a flexible chamber 20, as shown for example in FIG. 2. In FIG. 2, the system for performing localized electroless nickel plating generally indicated with reference numeral 200 which comprises a flexible chamber 20. As it will be apparent from the following, the system 100 and 200 is configured to be coupled to a portion of a metallic piece 1000 in order to perform the deposit of nickel plating on a portion of its surface.

With non-limiting reference to FIG. 1, the system 100 comprises chamber 10 having an inlet 11 and an outlet 12 and being configured to be fixedly coupled to the metallic piece 1000 so that the portion of the metallic piece 1000, in particular the portion which is under the chamber 10, and the chamber 10 define a closed volume V. The volume V of the chamber 10 may be configured to contain at least a first fluid, and in some embodiments different fluids which are supplied to the chamber 10 one after the other.

The inlet 11 is configured to supply the first fluid into the volume V and the outlet 12 is configured to discharge the first fluid from the volume V. Advantageously, the inlet 11 is located in a lower portion of the chamber 10 (with respect to a surface of the portion of the metallic piece when the chamber is in an operating condition) and the outlet 12 is located in an upper portion of the chamber 10 (with respect to the surface of the portion of the metallic piece when the chamber is in the operating condition). As it will be apparent from the following, the type and amount of fluid supplied to the volume V may vary, but the volume V is supplied at least with a plating fluid 52. In particular, known plating fluids, already used in plating baths, can be used to deposit a layer of nickel plating on the portion of the metallic piece 1000 under the chamber 10. Advantageously, the plating fluid 52 contains nickel and phosphorus, so that the plating fluid 52 may create an alloy of phosphorus in a range of 10-13% by weight with respect to nickel. For example, the plating fluid 52 may contain 21 g/l of nickel sulfate and 24 g/l of sodium hypophosphite. Advantageously, the plating fluid 52 is an acid solution having pH in the range of 4.3-4.6.

It is to be noted that a chemical reaction is performed in the volume V when the plating fluid 52 is in contact with the portion of the metallic piece 1000 under the chamber. In particular, when the chemical reaction occurs, gas bubbles are released inside the plating fluid 52. Advantageously, at least a portion of the chamber 10 can be made of a transparent or translucent material, so that an operator can check (in particular visually monitor) the progress of the reaction for example by controlling the release of the bubbles in the plating fluid 52.

As shown in FIG. 1, the chamber 10 may be rigid, in particular in the form of a bowl or a jar; it is to be noted that, for the purpose of the present invention, the term "rigid" is used to refer to a chamber which is unable to bend or be forced out of shape. For example, at least a portion of the chamber 10 can be made of a glass or a metal or a metallic alloy. It is to be noted that in some embodiments a portion of the chamber 10 may be the metallic piece itself: for example, if the piece on which electroless nickel plating is to be performed is the internal surface of a duct, the duct itself may act as chamber by closing the ends of the duct and providing an inlet on a first end and an outlet on a second end. With non-limiting reference to FIG. 1, the inlet 11 and the outlet 12 are located on lateral walls of the chamber 10 and are in particular small holes that may accommodate ducts, which are preferably sealed to the inlet 11 and outlet 12.

As previously indicated, the chamber 20 may be flexible, in particular in the form of a sheet or a shell laid on the portion of the metallic piece 1000 as shown in FIG. 2; it is to be noted that, for the purpose of the present invention, the term "flexible" is used to refer to a chamber which is able to bend or to be bent easily without breaking. For example, at least a portion of the chamber 20 is made of a silicone or a fluoroelastomer, in particular a thermosetting fluoroelastomer (for example Viton©), or (an)other polymer(s) which resists temperatures of at least 80° C., preferably temperatures of 85° C.-95° C., more preferably temperatures of 88° C.-92° C. In particular, a fast-acting silicone spray or a Viton® wire or other polymers can be used to build the walls of chamber 20, depending for example on the portion of the metallic piece 1000 to be repaired. Advantageously, this allows a complete adaptability of the chamber 20 to the geometry of the portion of the metallic piece 1000 to be repaired; in particular, the chamber 20 can adapt to many different shape, geometry and dimensions of the metallic piece 1000, such as edges, ducts and portions which are typically difficult to access. With non-limiting reference to FIG. 2, the inlet 21 and the outlet 22 are located on sides of the chamber 20 and are in particular small holes that may accommodate ducts, which are preferably sealed to the inlet 21 and outlet 22. Additionally or alternatively, the inlet 21 and/or the outlet 22 may accommodate a needle of a syringe, for example a needle made in plastic material or inox steel.

The system 100 or 200 may comprise further a fixing member 15 or 25, for example an adhesive or a magnet or a weight, configured to fixedly coupled the chamber 10 or 20 to the metallic piece 1000. If the chamber is rigid, for example in the form of ajar as shown in FIG. 1, the opening of the jar which is coupled to the metallic piece 1000 may have a magnetic strip along the edge so that the chamber 10 may be fixedly coupled to the metallic piece 1000. It is to be noted that if the metallic piece 1000 is planar, for example in the form of a plate, the chamber 10 may be placed on the metallic piece 1000 and kept fixedly coupled to the metallic piece 1000 by a weight. For example, if the chamber is flexible, in particular in the form of a sheet as shown in FIG. 2, the edge of the sheet may be fixedly coupled to the metallic piece 1000 by using an adhesive, in particular an acrylic or epoxy or vinyl adhesive.

The system 100 or 200 may comprise further a sealing member attached to the chamber 10 or 20 and configured to surround the portion of the metallic piece 1000.

As already mentioned, the volume V of the chamber may contain different fluids which, in some cases, are supplied to the chamber one after the other. In addition to the plating fluid 52, the volume V may be configured to receive also an alkaline fluid 53 (such as NaOH) and/or an acid fluid 54 (such as diluted HCl); advantageously, the chamber is resistant to these fluids 53 and/or 54. As it will be apparent from the following, the alkaline fluid 53 and/or the acid fluid 54 may be used to prepare the portion of the metallic piece to be treated with electroless nickel plating, in particular cleaning the surface with the alkaline fluid 53 and activating the surface with the acid fluid 54. Advantageously, the volume V may be further configured to receive and discharge water, which can be used to wash the chamber between one fluid and the next one.

With non-limiting reference to FIG. 1, the system 100 may comprise further a recirculation circuit 50 which is fluidly coupled to the inlet 11 and the outlet 12 of the chamber 10 and is configured to recirculate fluids from the volume V back to the volume V. In particular, the recirculation circuit 50 comprises at least one pump 51 for pumping fluids in the recirculation circuit 50 and tanks 62, 63 and 64 for storing fluids. For example, the recirculation circuit may have a common inlet duct in which is located the pump 51 and which is fluidly coupled to the inlet 11 and a common outlet duct which is fluidly coupled to the outlet 12; different circuit branches may be fluidly coupled to the inlet duct and the outlet duct, in which tanks 62, 63 and 64 of different fluids are respectively located. Advantageously, the chamber 10 works in slight depression, so that pump 51 sucks the fluids from the outlet 12 of the chamber and fluxes back it to the tanks 62, 63 and 64; this also allows a better stability and adhesion of the chamber 10 on the portion of the metallic piece 1000 to be repaired, in particular compared to working in overpressure. It is also to be noted that the system 100 may comprise further taps or valves (not shown in the figures) which are associated to different circuit branches and which allow and/or do not allow the passage of fluid in a circuit branch. In other words, each tank 62, 63 and 64 is independently fluidly coupled to the inlet 11 and arranged to store a specific fluid; in particular, each tanks 62, 63, 64 is arranged to store a different fluid.

Advantageously, the recirculating circuit 50 may comprise further a particulate filter (not shown in the figures). The particulate filter may filter the solid particles which may be present or created in one or more of the fluids 52, 53, 54 during the process.

According to another aspect, the subject-matter disclosed herein refers to a method for performing electroless nickel plating on a portion of a metallic piece. With non-limiting reference to FIGS. 1-3, the method comprises the steps of:

B) covering (see block 320 in FIG. 3) the portion of the metallic piece 1000 with a chamber 10 to define a closed volume V;

C) fixing (see block 330 in FIG. 3) the chamber 10 to the metallic piece 1000;

F) supplying (see block 360 in FIG. 3) a plating fluid 52 into the volume V through an inlet of the chamber 10;

G) discharging (see block 370 in FIG. 3) the plating fluid 52 from the volume V through an outlet of the chamber 10, 20; and H) removing (see block 380 in FIG. 3) the chamber 10 from the metallic piece 1000.

As already mentioned, the metallic piece may be covered with a rigid or a flexible chamber, depending for example on the shape of the metallic piece or the location of the portion of the metallic piece to be covered: for example, if step B is performed on a corner of a metallic piece, a flexible chamber may be used, preferably in the form of a sheet or a shell.

Preferably, the step C is performed by a fixing member of the chamber, in particular an adhesive or a magnet or a weight.

It is to be noted that step F and step G may be performed once or may be repeated several times. Advantageously, step F and step G are performed simultaneously, so that the plating fluid is continuously supplied into and discharged from the volume V of the chamber.

Figure 3:
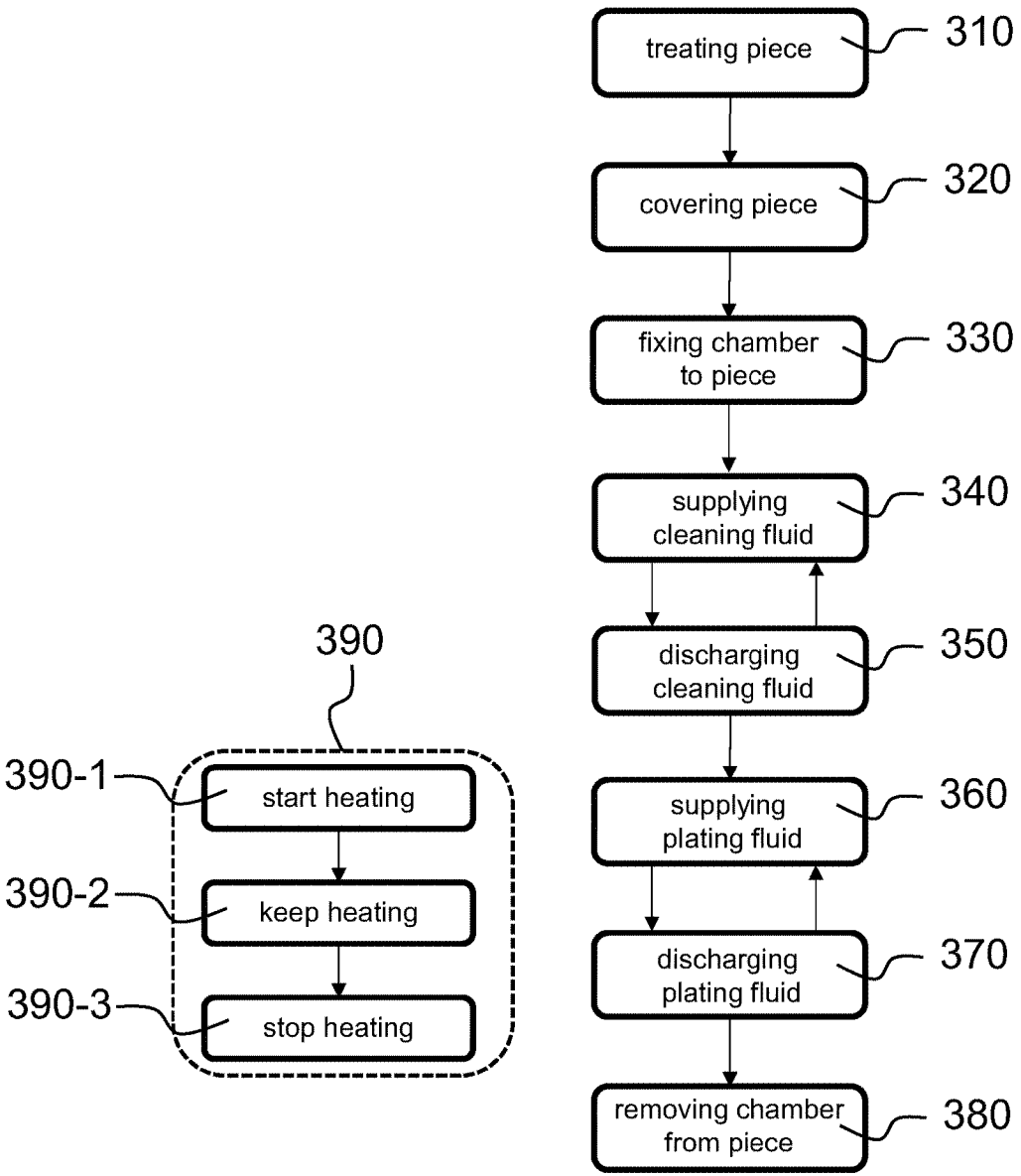
FIG. 3 shows a block diagram of an embodiment of a method for performing localized electroless nickel plating.

With non-limiting reference to FIG. 3, the method may further comprise a step D of supplying (see block 340 in FIG. 3) a cleaning fluid into the volume V through an inlet of the chamber and a step E of discharging (see block 350 in FIG. 3) the cleaning fluid from the volume V through an outlet of the chamber. Advantageously, step D and step E are performed before step F in order to prepare the portion of the metallic piece before the supplying of plating fluid, for example in order to clean and/or activate the surface of the portion.

It is to be noted that step D and step E may be performed once or may be repeated several times. Advantageously, step D and step E are performed simultaneously, so that the cleaning fluid is continuously supplied into and discharged from the volume V of the chamber. And in some cases, the repetition(s) of step D and step E is performed with a different cleaning fluid. For example, the first time step D and step E are preformed they may be performed with an alkaline fluid, the second time step D and step E are performed they may be performed with water and the third time step D and step E are performed they may be performed with an acid fluid.

Furthermore, steps D, E, F and G may be performed continuously, i.e. without removing the chamber from the metallic piece, so that the portion of the metallic piece to be treated is not exposed to air between one step of the method and the next one, thus avoiding oxidation of the portion which may create for example defects.

With non-limiting reference to FIG. 3, the method may further comprise a step A of treating (see block 310 in FIG. 3) the portion of the metallic piece with a chemical and/or mechanical treatment. In particular, step A realizes cleaning of the portion of a metallic piece 1000, for example by supplying a proper solvent or alkaline detergent into the volume V degreasing may be obtained or by performing a grit blasting. Typically, step A is performed before step B.

With non-limiting reference to FIG. 3, the method may further comprise a step I of heating (see block 390 in FIG. 3) the portion of the metallic piece. In particular, step I starts before or during step F and ends during or after step G, so that at least during the steps F and G the portion is heated up, at least up to 80° C., preferably up to 85° C.-95° C., more preferably up to 88° C.-92° C. It is to be noted that the portion of the metallic piece may be heated for example by induction, using resistances, using infrared lamps or using oxyacetylene flame; especially if the flame is used, the heat would preferably be applied on the other side of the metallic piece to be plated. Advantageously, also one or more of the tanks 62, 63, 64 and/or one or more of the fluids 52, 53, 54 and/or the recirculation circuit 50 may be heated.

It is also to be noted that step I of heating (see block 390 in FIG. 3) may be conceptually divided into three steps: a first step of starting heating (see block 390-1 in FIG. 3), a second step of keeping heating (see block 390-2 in FIG. 3), in particular to keep the portion of the metallic piece at the desired temperature, and a step of stopping heating (see block 390-3 in FIG. 3).

The invention claimed is:

1. A system for performing electroless nickel plating on a portion of a metallic piece, the system comprising:

a chamber having an inlet and an outlet, the chamber having a size that is smaller than the metallic piece, the chamber defining a volume, wherein the chamber is configured to be fixedly coupled to the metallic piece so that the portion of the metallic piece and the chamber together define a closed volume, wherein the inlet and the outlet are configured to allow a first fluid to flow continuously into and out of the volume, respectively, so as to expose the metallic piece to the first fluid, wherein the first fluid is a plating fluid.

2. The system of claim 1, wherein the chamber is rigid.

3. The system of claim 1, wherein the chamber is flexible.

4. The system of claim 1, wherein the chamber comprises one of glass, metal, or metallic alloy.

5. The system of claim 1, wherein the chamber comprises silicone, fluoroelastomer, or polymer.

6. The system of claim 1, wherein the chamber comprises a transparent or translucent material.

7. The system of claim 1, further comprising:

a fixing member comprising an adhesive, a magnet, or a weight, wherein the fixing member is configured to fixedly couple the chamber to the portion of the metallic piece.

8. The system of claim 1, further comprising:

a sealing member attached to the chamber and circumscribing the portion of the metallic piece.

9. The system of claim 1, further comprising:

a recirculation circuit fluidly coupled to the inlet and the outlet wherein the recirculation circuit is configured to recirculate at least the first fluid from the outlet of the volume back to the inlet of the volume.

10. The system of claim 1, further comprising:

a pump for pumping at least the plating fluid from the outlet of the volume to the inlet of the volume; and a first tank for storing the plating fluid.

11. The system of claim 1, further comprising:

a recirculation circuit fluidly coupled to the inlet and the outlet, wherein the recirculation circuit is configured to recirculate a second fluid from the outlet of the volume back to the inlet of the volume, wherein the second fluid is an alkaline fluid or an acid fluid, and wherein the chamber is resistant to the one second fluid.

12. The system of claim 1, further comprising:

a recirculation circuit fluidly coupled to the inlet and the outlet, wherein the recirculation circuit comprises a first tank for storing the plating fluid and a second tank for storing a second fluid.

13. The system of claim 1, wherein the chamber forms a bowl.

14. The system of claim 1, wherein the chamber forms a jar.

15. The system of claim 1, wherein the chamber forms a sheet.

16. The system of claim 1, wherein the chamber forms a shell.

17. The system of claim 1, wherein the chamber is resistant to temperatures of at least 80° C.

18. The system of claim 12, wherein the second fluid is an alkaline fluid.

19. The system of claim 12, wherein the second fluid is an acid fluid.

20. An apparatus for electroplating a metallic piece, the apparatus comprising:

a chamber smaller than the metallic piece, the chamber comprising ports providing access to a volume formed inside the chamber;

a recirculation circuit coupled to the ports; and a fixing member coupling the chamber and the metallic piece to close the volume of the chamber, wherein operation of the recirculation circuit transports fluid between the ports to continuously circulate fluid into and out of the volume to cause electroplating of only a portion of the metallic piece that is under the chamber and in communication with the volume.

* * * * *